US005341776A

United States Patent [19]

Phelps

[11] Patent Number: 5,341,776

[45] Date of Patent: Aug. 30, 1994

[54] FUEL SUPPLY SYSTEM

[76] Inventor: Harold E. Phelps, 1845 B Franciscan Ter., Winston Salem, N.C. 27127

[21] Appl. No.: 89,483

[22] Filed: Jul. 12, 1993

[51] Int. Cl.[5] ..... F02B 33/04

[52] U.S. Cl. ..... 123/73 C; 123/DIG. 5; 261/35; 261/41.1; 417/395

[58] Field of Search ..... 123/73 C, DIG. 5, 387; 417/380, 395; 261/35, 41.1, 41.5

[56] References Cited

U.S. PATENT DOCUMENTS 2,969,963 1/1961 Brown ..... 123/DIG. 5

4,552,101 11/1985 Borst et al. ..... 123/DIG. 5

4,903,655 2/1990 Vonderau et al. ..... 123/DIG. 5

*Primary Examiner*—Noah P. Kamen

*Attorney, Agent, or Firm*—Gifford, Groh, Sprinkle, Patmore and Anderson

[57] ABSTRACT

A closed loop fuel supply system for operating engines in all possible attitudes in which fuel is delivered by a vacuum pump responsive to the vacuum level in the crank case of the engine and in which the vacuum driving the pump is modulated in response to the pressure of fuel being delivered to the fuel supply system so that the amount of fuel delivered for combustion purposes is equal to the requirements of the engine without any excess so that a fuel return line is not required.

13 Claims, 1 Drawing Sheet

FUEL SUPPLY SYSTEM

This invention relates to a fuel supply system for small internal combustion engines.

In the operation of small internal combustion engines of the two cycle type which are used with a variety of portable powered tools such as chain saws, leaf blowers and the like, the carburetor must be very small and compact and be capable of operating in all positions of the engine.

Typically with such two cycle engine fuel systems, little attention has been given to efficiency and the primary concern has been to insure sufficient fuel for operation in a wide range of engine speeds varying from 3000 to 8000 rpm. To insure sufficient fuel, it has been the practice to deliver fuel in proportion to the engine speed and to provide for a return of any excess fuel through a return system to the fuel tank. Most of such fuel arrangements are difficult to control particularly, at low speeds when the fuel requirements are low. The problem becomes aggravated when the engine is operating at high speed and it is desired to reach low speed as rapidly as possible. For example, an engine used with a chainsaw may operate at high speed to make a cut but when the cut is finished the operator will move the throttle to a closed or idle position and the delivery system must react very rapidly or fuel continues to be delivered in excess of the amount required for operation. This results in excess fuel being exhausted to the atmosphere and causes air pollution. In recognition of the pollution problems, various government agencies are making regulations relative to the content of exhaust gases from such engines.

It is an object of the present invention to provide a fuel delivery system in which fuel is delivered to the engine at the appropriate level required for operation throughout the full range of operating speeds.

Another object of the invention is to provide a fuel delivery system which responds to the fuel being consumed by the engine to regulate the pressure of fuel being delivered for ignition.

Yet another object of the invention is to provide a fuel delivery system which delivers the required amount of fuel to the engine for all levels of operation without requiring a return line to the reservoir.

SUMMARY OF THE INVENTION

The fuel supply system of the invention incorporates a housing with a mixing passage for supplying a mixture of fuel and air to the engine, a throttle valve disposed in the passage for controlling the supply of fuel and air mixture to the engine and a pump operating in response to vacuum pulsations in the crank case of the engine to receive fuel from a fuel reservoir and deliver that fuel to a metering system connected to the mixing passage. The fuel control system is responsive to the pressure of fuel being delivered by the pump to the metering system to regulate the level of vacuum available to drive the fuel pump thereby controlling the output pressure of fuel from the pump to the fuel metering system so that fuel delivery is proportion to the vacuum level resulting from rotation of the engine. Only the fuel required is delivered to the combustion chambers making it unnecessary to provide a return loop to the fuel tank. The arrangement further provides for shutting off the supply of fuel at any time the rotation of the engine stops.

The objects of the invention will become apparent from the following description and the drawings of a preferred embodiment in which:

FIG. 1 is a diagrammatic view of the fuel supply system embodying the invention.

DETAILED DESCRIPTION

Figure 1:
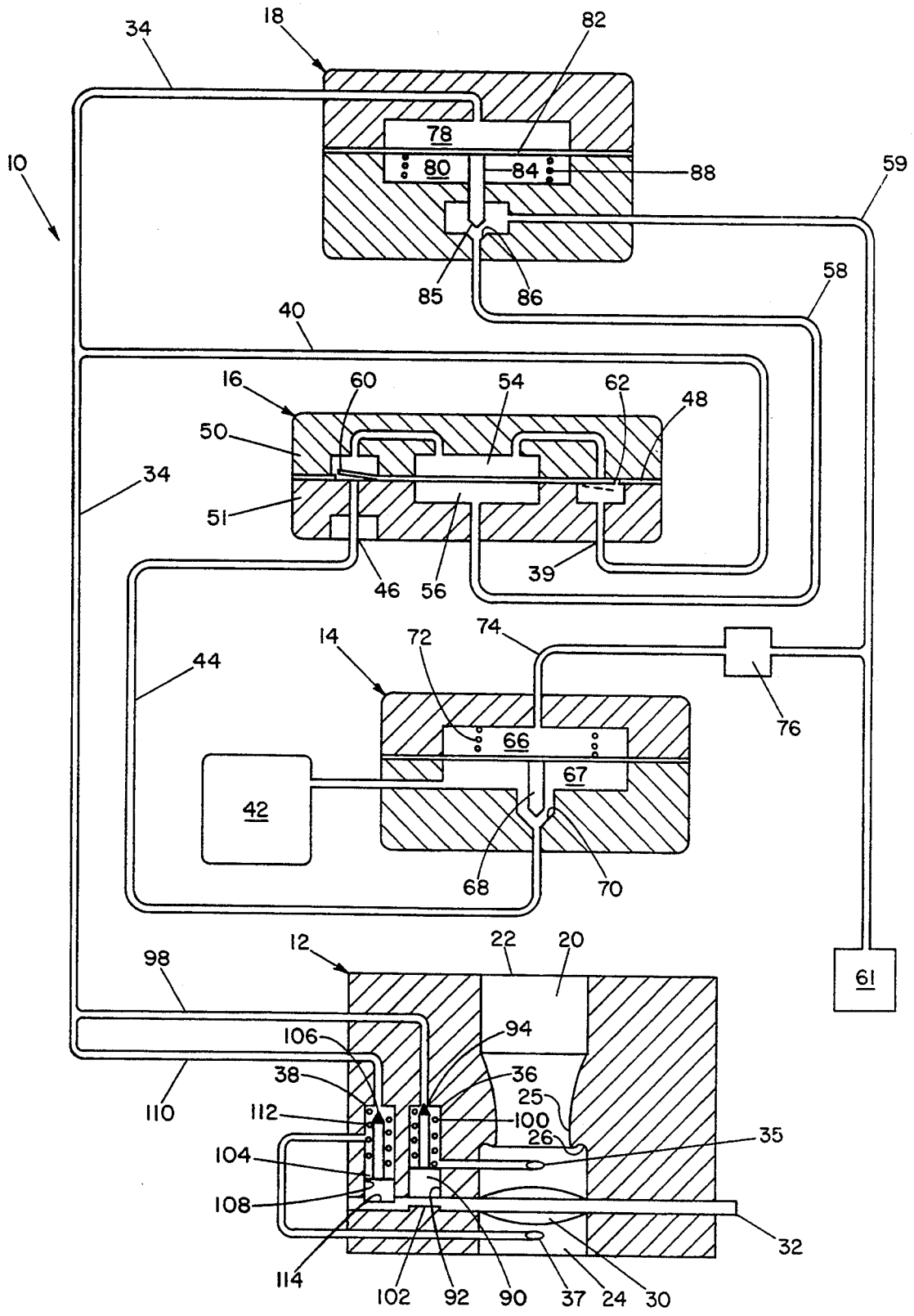

A closed loop carburetor and fuel supply system of the present invention is incorporated in a single housing 10 which in the drawings is represented by separate housing portions illustrating a carburetor section 12 a fuel shutoff valve 14 a pump 16 and a fuel pressure regulator 18.

The present invention is directed to two cycle engines of the type used with chain saws for example and must be capable of operation in all positions, including a fully inverted position.

Two cycle engines operate by drawing air and fuel through the carburetor section into the crank case of the engine. During the compression stroke of the piston, a mixture of air and fuel is bled from the engine crank case into the engine cylinder. The crank case undergoes a change in pressure from sub-atmospheric or vacuum pressure to positive pressure above atmospheric pressure. These pressure fluctuations are utilized for operating the pump section 16 in the embodiment of the present invention.

The carburetor section 12 includes a bore 20 having an inlet opening 22 and an outlet opening 24 Between the openings 22 and 24 is a restricted venturi passage indicated at 25. The venturi passage is undercut as indicated at 26 to form an annular groove facing toward the outlet end 24. The bore 20 forms a fuel and air mixing passage by which air enters at the large opening 22 and is delivered to the open end 24 communicating with the intake manifold of the engine. The venturi passage 25 acts to create a low pressure effect during air flow due to the restriction of the venturi portion and the undercut 26 acts to restrict back flow of a mixture of air and fuel against the stream of incoming air which can be an undesirable characteristic, particularly at high operating speeds of the engine.

A conventional butterfly type of throttle valve 30 is mounted on a shaft 32 journaled in the walls of the housing portion 12 for movement between open and closed positions.

Fuel to the mixing passage formed by the bore 20 of the carburetor section 12 is delivered from pump 16 by way of main fuel conduit 34 to a fuel outlet 35 forming part of a high speed metering portion or section indicated at 36 and a fuel outlet 37 forming part of a low speed metering portion or section indicated at 38. The fuel conduit 34 is connected to the outlet 39 of pump 16 by way of a branch conduit 40. The pump 16 receives fuel from a tank 42 through the control or shut off valve 14 and a fuel conduit 44 connected to the inlet 46 of the pump 16.

The pump 16 is of the diaphragm type in which a diaphragm 48 is sandwiched between housing portions 50 and 51 A portion of the . diaphragm 48 is located in a cavity formed in the housing portions 50 and 51 and acts to divide the cavity into a fuel chamber 54 and pumping chamber 56. The pumping chamber 56 is connected to a source of vacuum through the fuel pressure regulator 18 by way of a vacuum conduits 58 and 59. The vacuum source is the engine crank case indicated at 61. Vacuum pressure pulsations within the crank case 61 also are developed in the pumping chamber 56 of pump 16. This causes the diaphragm 48 to flex and pulse. The pump diaphragm 48 also has a flap forming an inlet valve 60 associated with the inlet 46 and a flap forming an outlet valve 62 associated with fuel conduit 39 communicating with branch line 40 and fuel delivery conduit 34. The flaps forming the inlet and outlet valves 60 and 62 are in a single unitary sheet of elastomeric material making up the diaphragm 48.

The inlet valve 60 controls the admission of fuel to the pump 16 from the line 44. As a result of pulsations of pressure in the pumping chamber 56, the diaphragm 48 flexes in one direction to draw fuel from the line 44 through the valve 60. Upon flexing of the diaphragm in the opposite direction, fuel is delivered through the outlet valve 62 to branch line 40 communicating with the fuel conduit 34 delivering fuel to the high and low speed metering circuits 36 and 38. When vacuum pressure, that is sub-atmospheric pressure, exists in the pumping chamber 56, the diaphragm 48 will flex downwardly from the position shown in the drawings causing a low pressure in the fuel chamber 54. This causes outlet valve 62 to close and inlet valve 60 to open to draw fuel from the tank 42. When the pressure in the pumping chamber 64 changes to a positive or super atmospheric pressure, the diaphragm 48 flexes upwardly increasing the pressure in the fuel chamber 54 causing the inlet flap valve 60 to close and at the same time to open outlet flap valve 62 so that fuel is delivered from the chamber 54 through branch line 40 to fuel conduit 34. As a result of the pumping action the output pressure in the branch line 40 and fuel conduit 34 is to the order of one half to one psi which is sufficient to maintain the fuel delivery lines filled with fuel which is made available at the high speed and low speed circuits 36 and 38

Fuel delivered by the pump 16 from the tank 42 is under the control of a shut off valve 14. The shut off valve 14 is formed in the main housing 10 and includes a diaphragm 64 sandwiched between housing portions and forming a vacuum chamber 66 above the diaphragm and a fuel chamber 67 below the diaphragm. The central portion of the diaphragm 64 is connected to a needle valve 68 adapted to move with the diaphragm between an open position and a closed position seated on a valve seat 70. The needle valve 68 normally is urged to a closed position by a spring 72 in chamber 66 acting on diaphragm 64. The vacuum chamber 66 is connected by a line 74 to vacuum conduit 59 communicating with the crank case of the engine. The line 74 also contains a stabilizer valve 76. The stabilizer 76 is in the form of a one way check valve positioned to open in response to the vacuum portion of the pulsating pressure established in the crankcase 61 and conduit 59 to establish and maintain vacuum pressure in chamber 66. This serves to dampen the pulsating effect of the pumping vacuum in conduit 59. Any time the engine is rotating and creating a vacuum in the crank case, the vacuum also is established in the chamber 66 which causes the diaphragm 64 to overcome the action of spring 72 and lift needle m valve 68 from its seat 70. In the open condition of the valve, the tank 42 is in communication with the inlet 46 of the pump 16. When the operation of the engine is stopped for any reason the vacuum of chamber 66 is terminated and the action of the spring 72 moves the needle valve to a closed position to stop communication between the fuel tank 42 and the pump 16 and therefore stops delivery of fuel to the carburetor 12.

The amount of fuel delivered to the carburetor 12 by the pump 16 is under control of the pressure regulator 18. The pressure regulator 18 is disposed in the housing 10 and is formed by a housing section which forms a cavity divided into chambers 78 and 80 by a diaphragm 82. The upper chamber 78 is connected to the fuel conduit 34 and is typically occupied or filled with fuel at delivery pressure A central portion of the diaphragm 82 is connected to a stem 84, the end of which forms a valve element 85 moveable between open and closed positions relative to a valve seat 86. The diaphragm 82 is urged upwardly by a spring 88 seated in chamber 80. The valve seat 86 normally is fully open when the engine is not operating. As soon as rotation of the engine begins a vacuum is created in chamber 80 which is made available through the open valve 85, 86 to the pumping chamber 56 of the pump 16. As the engine continues to operate, fuel pressure is developed in the branch line 40 and the fuel conduit 34 to be made available in the fuel chamber 78 in the fuel pressure regulator 18. The pressure of fuel in the chamber 78 determines the extent of movement of the valve stem 84 and the degree of valve opening. In this manner, the vacuum made available to operate the fuel pump 16 is modified in accordance with the fuel pressure being developed by the pump 16 so that only the amount of fuel being used by the engine is delivered from the pump. In other words the vacuum level available to operate the pump 16 is modulated by regulator 18 in proportion to fuel pressure being delivered.

Fuel delivered by the pump 16 to the branch line 40 and fuel conduit 34 is distributed through the high speed and low speed metering circuits 36 and 38. The high speed metering circuit 36 includes a plunger 90 slidable in a bore 92. The plunger 90 as stem, the end of which is formed with a conical rubber tip 94 that is engageable with a seat formed by an opening at the end of high speed fuel line 98 of the high speed metering circuit 36. The valve element formed by the tip 94 is urged toward an open position spaced from its seat by a spring 100 The lower end of the plunger 90 is seated on the surface of throttle shaft 32. As shown in the drawing, this is the closed position of the valve 94. An indentation or notch 102 is formed in the shaft 32 opposite to the surface on which the plunger 90 is seated as illustrated in the drawing. Upon opening the throttle valve 30 by rotating the shaft 32, plunger 90 moves into the notch 102 and the valve element 94 moves from its seat under the urging of spring 100, permitting the passage of fuel from the high speed metering conduit 98 passing the open valve element 94, and through a delivery conduit ending at the high speed outlet 35 in the venturi passage 24. When the throttle valve 30 is turned to a closed position the lower end of plunger 90 moves out of the indentation 102 and is seated on the outer surface of shaft 32 which raises plunger 90 against the action of spring 100 and returns the valve element 94 to its closed position. This prevents further delivery of fuel in the high speed metering system 36 to the outlet 35 in the venturi passage 24 upstream of the throttle valve 30.

The idle or low speed metering circuit 38 includes a plunger 104 having a stem with a rubber tip 106 forming a valve element similar to the valve element 94 used in association with the high speed metering circuit The plunger 104 is slideably mounted in a bore 108 and is continuously urged away from its seat formed at the end of fuel line 110 by a spring 112. In the open position of valve element 94, plunger 104 is seated in a notch 114 disposed on the opposite side of shaft 32. The arrangement of notches 102 and 114 causes valve element 94 to be closed when valve element 106 is open and vice versa.

In operation, the two cycle engine is started by rotation of its crankshaft which creates a vacuum in the crank case that is immediately established in chamber o 66 f shut-off valve 14 to overcome the action of spring 72 and open valve 68, 70 so that the fuel tank 42 is in full communication through the open valve and the line 44 to the inlet 46 of the pump 16. At the same time vacuum pressure is established in the conduit 59 and 58 to the chamber 56 of pump 16 so that pumping action can begin. Such pumping action draws fuel from the tank 42 and delivers it under pressure to the outlet 39 of the pump 16. From the outlet 39 fuel is made available through branch conduit 40 and fuel conduit 34 through the open low speed metering system 38. At this time the low speed metering valve 106 is open and the high speed metering valve 94, 92 is closed. Fuel, therefore, is delivered through the feed line 112 downstream of the throttle valve 30 so that the engine can start ignition. The engine will operate at low speed until the throttle valve 30 is moved to a more fully opened position. The high speed valve element 94 will open and low speed valve 106 will close on their respective seats so that fuel is made available to the mixing passage 28 through the high speed fuel outlet 35 only. The engine will be rotating at a high rate of speed and the level of vacuum pressure will increase and be made available in the pumping chamber 56 to result in a higher fuel output of the pump 16. This fuel output also is made available in the fuel chamber 78 of the fuel pressure regulator 18 causing the diaphragm 82 to deflect against the action of spring 88 to move the valve stem 84 toward a closed position on the seat 86. The valve remains partially open but restricts the level of vacuum pressure made available in the vacuum conduit 58 from the line 59. This modulates the level of vacuum pressure available in the pumping chamber 56 and therefore the pumping action of the pump 16. As a consequence the output of fuel from the pump 16 is in proportion to the fuel being used in the passage 20 because the pumping action is being modulated in accordance with the requirements for fuel by the engine which is made available in the fuel pressure chamber 78.

If the throttle valve 30 should be moved from a fully open position to a fully closed position, the high speed circuit 36 is immediately closed due to the unseating of the plunger from the notch 102 and the simultaneous opening of the valve 106 to the low speed circuit. In this manner, the delivery of excess fuel is prevented and only the amount of fuel required by the engine is delivered through the delivery conduit 34.

If for any reason the engine should stop operating, whether operating at high or low speed, the source of vacuum for operating the pump 16 will be eliminated but more importantly, valve 14 will immediately move to a closed position under the action of the spring 72 in chamber 66 so that fuel tank 42 is isolated from the fuel delivery system From this it can be seen that only the amount of fuel required is delivered and as a consequence it is unnecessary to provide a return system for excess fuel to the tank 42. As a consequence, the present system is regarded as a closed loop system.

Moreover the fuel delivery system may be regarded as a low pressure injection system in that the pressure of the fuel being delivered to the conduit 34 is to the order of one half to one psi.

A fuel supply system for a two cycle engine has been provided in which the delivery of fuel is proportional to the vacuum level resulting from crankshaft rotation during operation of the engine so that only the fuel being used is delivered making it unnecessary to provide a return loop to the fuel tank. Furthermore, both the high speed and low speed delivery circuits are under the control of a shutoff valve such that when engine operation stops for any reason, delivery of fuel to the high speed and low speed circuits also stops.

We claim:

1. A fuel supply system for operating an engine in various positions including an inverted position, comprising:

a housing, a mixing passage in said housing for supplying a mixture of fuel and air to the engine, a throttle valve in said passage for controlling the supply of air and fuel mixture to the engine, a pump operative in response to vacuum pulsations in conduit communicating with the crank case of the engine and having an inlet for receiving fuel and an outlet for delivering fuel, a fuel metering system connected to said outlet of said pump and to said mixing passage, and fuel control means responsive to the level of pressure of fuel delivered by said pump to regulate the level of vacuum in said conduit to drive said pump and thereby regulate the output pressure of fuel from said pump to said fuel metering system.

2. The fuel supply system of claim 1 wherein said fuel control means includes a valve in said vacuum conduit communicating said crank case of the engine and said pump, said valve being moveable between open and closed positions in response to the pressures of fuel delivered to said metering systems.

3. The fuel supply system of claim 1 wherein said fuel metering system includes a high speed portion have a fuel outlet communicating with the upstream side of said throttle valve and a low speed metering portion having fuel outlet communicating with the downstream side of said throttle valve.

4. The fuel supply system of claim 3 wherein said high speed portion of said fuel metering system is closed to fuel flow by a first valve when said low speed portion of said fuel metering system is open to fuel flow and said low speed portion of said fuel system is closed by a second valve when said high speed portion of said fuel metering system is open to fuel flow.

5. The fuel supply system of claim 4 wherein the opening and closing of said first and second valves is in response to the position of said throttle valve.

6. The fuel supply system of claim 5 wherein said first valve is in a closed position and said second valve is in an open position when said throttle valve is in a closed position.

7. The fuel supply system of claim 1 and further comprising means to stop delivery of fuel to said metering system in response to interruption of rotation of said engine.

8. The fuel supply system of claim 7 wherein said means to stop fuel delivery of fuel includes a valve responsive to the vacuum developed in said engine crank case when said engine is operating to hold said valve in an open position.

9. A fuel supply system for operating an engine in various positions including an inverted position, comprising:

a housing, a mixing passage in said housing for supplying a mixture of fuel and air to the engine, a throttle valve in said passage for controlling the supply of air and fuel mixture to the engine, a pump operative in response to vacuum pulsations in the crank case of the engine and having an inlet for receiving fuel and an outlet for delivering fuel, a high speed metering system and a low speed metering system connected to said outlet and to said mixing passage, valve means at said fuel inlet responsive to the presence of vacuum resulting from rotation of said engine to permit delivery of fuel to said pump and responsive to lack of vacuum to prevent delivery of fuel to said pump, and fuel pressure regulating means responsive to the level of fuel pressure from said pump to regulate the level of vacuum pressure available from said crank case to regulate drive vacuum to said pump and the output pressure of fuel from said pump to said high and low speed metering systems.

10. A closed loop fuel supply system for operating an engine in all possible positions, comprising:

a housing, a mixing passage in said housing for supplying a mixture of fuel and air to the engine, a throttle valve in said passage for controlling the supply of air and fuel mixture to the engine, a pump operative in response to vacuum pulsations in the crank case of the engine and having an inlet for receiving fuel and an outlet for delivering fuel, a high speed metering system and a low speed metering system connected to said outlet of said pump and to said mixing passage, said high speed and low speed metering systems each including a shut off valve responsive to the position of said throttle valve, said high speed metering system being open and said low speed metering system being closed to said mixing passage when said throttle valve is open and said low speed metering system being open and said high speed metering system being closed to said mixing passage when said throttle valve is closed, valve means at said fuel inlet responsive to the presence of vacuum resulting from rotation of said engine to permit delivery of fuel to said pump, and fuel pressure regulating means responsive to the pressure of fuel from said pump to regulate the level of vacuum pressure available from said crank case to said pump to regulate the level of drive vacuum to said pump and the output of fuel from said pump to said high and low speed metering systems whereby the amount fuel delivered to said mixing passage is equal to the requirements of the engine.

11. The closed loop fuel supply system of claim 10 including a valve in a vacuum line between said crank case and said pump, said valve being moveable between fully open and fully closed positions to regulate the level of vacuum delivered to said pump to drive the latter.

12. The closed loop fuel supply system of claim 11 in which said fuel pressure regulating means includes a spring acting on said valve to urge the latter to a fully open position.

13. The closed loop fuel supply system of claim 12 wherein said fuel pressure regulating means includes a diaphragm connected to said valve to move said valve in responds to pressure of fuel delivered to said metering system and acting on one side said diaphragm in opposition z to said spring to urge said valve toward an open position.

* * * * *